US007497600B2

(12) United States Patent
Sekela et al.

(10) Patent No.: US 7,497,600 B2
(45) Date of Patent: Mar. 3, 2009

(54) BOOSTER OPTIC

(75) Inventors: William Sekela, Aurora, OH (US); Alan Toot, Warren, OH (US); Mark Mayer, Sagamore Hills, OH (US); Mathew Sommers, Sagamore Hills, OH (US)

(73) Assignee: Lumination LLC, Valley View, OH (US)

( * ) Notice: Subject to any disclaimer, the term of this patent is extended or adjusted under 35 U.S.C. 154(b) by 175 days.

(21) Appl. No.: 11/468,662

(22) Filed: Aug. 30, 2006

(65) Prior Publication Data

US 2008/0055913 A1 Mar. 6, 2008

(51) Int. Cl.
*F21V 7/00* (2006.01)

(52) U.S. Cl. ..... 362/346; 362/127; 362/133; 362/240; 362/241; 362/247

(58) Field of Classification Search ..... 362/127, 362/133, 134, 240, 241, 247, 346, 545, 800
See application file for complete search history.

(56) References Cited

U.S. PATENT DOCUMENTS 6,964,507 B2 * 11/2005 Mohacsi ..... 362/545
2005/0174802 A1 * 8/2005 Wu et al. ..... 362/602
2005/0265019 A1 12/2005 Sommers et al.
2007/0159820 A1 7/2007 Crandell et al.
2007/0195535 A1 8/2007 Artwohl et al.

FOREIGN PATENT DOCUMENTS

| | | |
|---|---|---|
| EP | 1496488 | 1/2005 |
| FR | 2833070 | 6/2003 |
| WO | WO 2006/067777 | 6/2006 |

OTHER PUBLICATIONS

Photographs of a device sold by Anthony's Manufacturing Company, Inc., San Fernando, CA, Jan. 31, 2006 (4 pages).

* cited by examiner

*Primary Examiner*—Sandra L. O'Shea
*Assistant Examiner*—Meghan K. Dunwiddie
(74) *Attorney, Agent, or Firm*—Fay Sharpe LLP

(57) ABSTRACT

A booster optic is provided in an LED light assembly that includes a primary reflective surface to redirect light towards a desired location to form an illuminance pattern that when combined with a first illuminance pattern, which is formed by only the primary reflector, provides a combined illuminance pattern having a more uniform illuminance characteristic as compared to not having the booster optic.

21 Claims, 10 Drawing Sheets

BOOSTER OPTIC

BACKGROUND

Lighting systems are used to illuminate display cases, such as commercial refrigeration units, as well as other display cases that need not be refrigerated. Typically, a fluorescent tube is used to illuminate products disposed in the display case. Fluorescent tubes do not have nearly as long a lifetime as a typical LED. Furthermore, for refrigerated display cases, initiating the required arc to illuminate a fluorescent tube is difficult in a refrigerated compartment.

With reference to FIG. 1, a typical refrigerated case 10 has a door and frame assembly 12 mounted to a front portion of the case. The door and frame assembly 12 includes side frame members 14 and 16 and top and bottom frame members 18 and 22 that interconnect the side frame members. Doors 24 mount to the frame members via hinges 26. The doors include glass panels 28 retained in frames 32 and handles 34 may be provided on the doors. Mullions 36 mount to the top and bottom frame members 18 and 22 to provide door stops and points of attachment for the doors 24 and/or hinges 26.

The enclosure 10 described can be a free-standing enclosure or a built-in enclosure. Furthermore, other refrigerated enclosures may include a different configuration, for example a refrigerated enclosure may not even include doors. The lighting systems provided in this application can also be used with those types of refrigerated enclosures, as well as in a multitude of other applications.

LED devices have also been used to illuminate refrigerated display cases. These known systems, however, employ LED devices that emit light at a narrow angle and include complicated optics and reflectors to disperse the light.

SUMMARY

A lighting assembly for illuminating items in a display case includes a plurality of LED devices, a reflector, and a booster optic. The reflector includes a central axis and is disposed in relation to the LED devices such that light emitted from the LED devices reflects from a primary reflective surface of the reflector and is directed towards items in the display case. The booster optic extends from the primary reflective surface of the reflector in a direction which is generally the same as a direction that each of the plurality of LED devices extend with respect to the reflective surface. The booster optic includes a secondary reflective surface associated with a first LED device of the plurality of LED devices. The secondary reflective surface is configured and positioned with respect to the first LED device such that light emitted from the first LED device towards the secondary reflective surface reflects from the secondary reflective surface and is redirected further away from the central axis of the primary reflective surface.

A booster optic for a lighting assembly including a primary reflective surface and at least one light source includes a body. The body of the booster optic includes means for attaching the body to the primary reflective surface and a first reflective surface. The first reflective surface of the body is configured to redirect light from the light source that does not contact the primary reflective surface toward a desired location.

A light assembly includes a first LED device, a primary reflector and a booster optic. The primary reflector is disposed with respect to the first LED device such that light emanating from the first LED device is redirected from the primary reflector towards a desired location to form a first illuminance pattern. A booster optic is configured and disposed with respect to the first LED device and the primary reflector such that light emanating from the first LED device is redirected towards at least one of the desired location and the primary reflector to form a second illuminance pattern that when combined with the first illuminance pattern, provides a combined illuminance pattern having a more uniform illuminance characteristic as compared to the first illuminance pattern.

DETAILED DESCRIPTION

Figure 2:
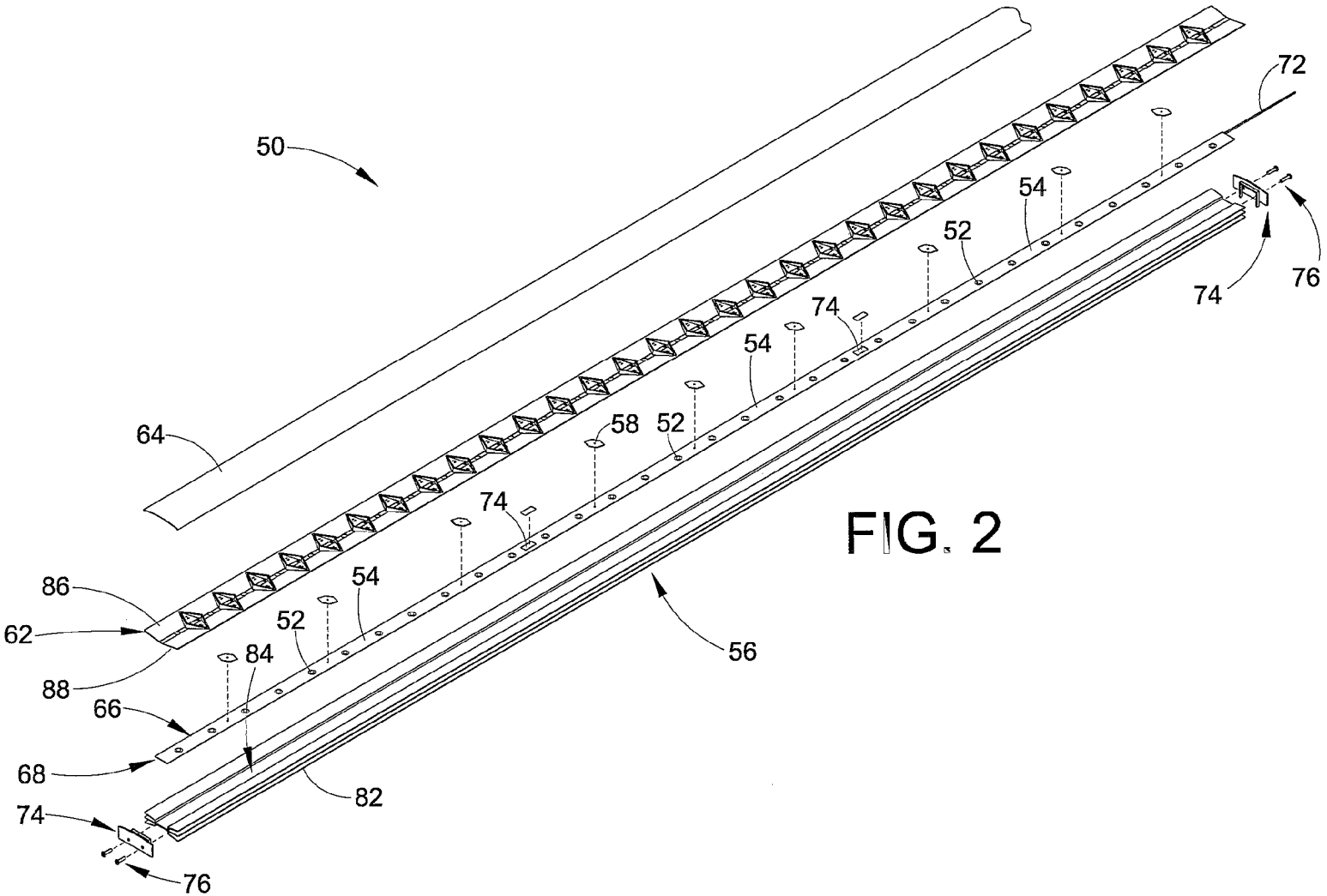
FIG. 2 is an exploded view of a lighting assembly for use in a commercial refrigeration display case such as the one depicted in FIG. 1.

With reference to FIG. 2, in the depicted embodiment a lighting assembly 50 includes a plurality of LED devices 52 mounted on printed circuit boards 54. The printed circuit boards 54 mount to a heat sink 56 using fastening devices 58. A reflector 62 also connects to the heat sink 56. A translucent cover 64 also attaches to the heat sink 56 and covers the LED devices 52. This portion of the lighting assembly is more fully described in U.S. Patent Application Publication No. US 2005/0265019 A1, which is incorporated by reference herein in its entirety.

The printed circuit board 54 in the depicted embodiment is a metal core printed circuit board ("MCPCB"); however, other circuit boards can be used. The MCPCB 54 has a long rectangular configuration that cooperates with the heat sink 56 to remove heat generated by the LED devices 52. The printed circuit board 54 includes a plurality of traces (not shown) interconnecting the LED devices 52. The traces are formed in a dielectric layer that is disposed on a first, or upper as shown in FIG. 2, surface 66 of the MCPCB 54. Contacts for the LED devices 52, which are in electrical communication with the traces, are in thermal communication with a metal core portion of the MCPCB 54, which is disposed below the dielectric layer. The MCPCB 54 includes a second, or lower per the configuration shown in FIG. 2, surface 68 opposite the upper surface 66. Heat from the LED devices 52 is drawn through the metal core portion of the MCPCB 54 and dissipated through the lower surface 68 into the heat sink 56. In an alternative embodiment, the LED devices can be electrically connected via flexible conductors similar to a string light engine.

The plurality of LED devices 52 mount on the upper surface 66 of the MCPCB 54. Wire conductors 72 extend from the MCPCB 54 and are connected to the traces, which are connected to the LED devices 52. The conductors 72 connect to a power source (not shown) to provide electrical power to the lighting assembly 50. Socket strip connectors 74 are disposed at appropriate locations along the MCPCB 54 to electrically connect one MCPCB to another.

As mentioned above, the MCPCB 54 mounts to the heat sink 56. In the depicted embodiment, the heat sink 56 is made of a heat conductive material, which in the depicted embodiment is an extruded aluminum. The heat sink 56 in the embodiment depicted in FIG. 2 is symmetrical along a longitudinal axis and includes a plurality of fins 82 that run parallel to the longitudinal axis to increase its surface area for more efficient heat dissipation. The heat sink 56 includes a channel 84 that receives the MCPCB 54.

Figure 1:
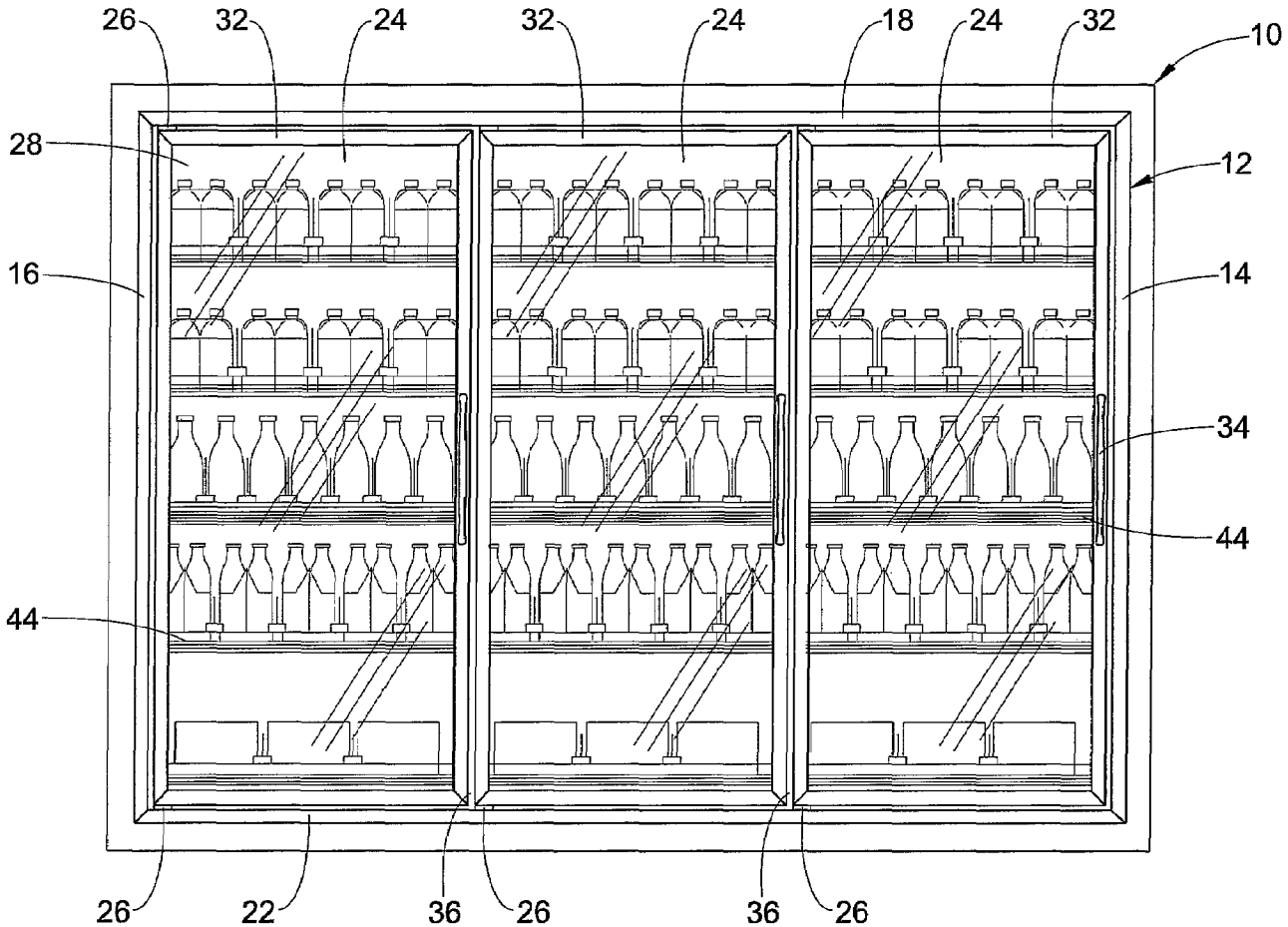
FIG. 1 is a plan view of a typical commercial refrigeration display case.

The heat sink 56 mounts to a standard mullion, for example the mullion 36 depicted in FIG. 1, of a commercial refrigeration unit, and therefore can have a width that is substantially equal to a standard mullion. End caps 74 mount to opposite longitudinal ends of the heat sink 66 using fasteners 76. The end caps 76 can provide a mounting structure to facilitate attachment of the lighting assembly to the mullion. The assembly 50 can mount to the mullion in other manners, one of which will be described in more detail below.

The printed circuit board 54 mounts to the heat sink 56 using a fastening device, which will be referred to as a cam 58. In the depicted embodiment, the cam 58 holds the MCPCB 54 against a lower surface of the channel 84 formed in the heat sink 56. To further facilitate heat transfer between the MCPCB 54 and the heat sink 56, a thermally conductive interface material (not shown), for example a tape having graphite, can be interposed between the lower surface 68 of the MCPCB 54 and the mounting surface of the heat sink 56. In an alternative embodiment, a double-sided thermally conductive tape can be used to attach the MCPCB 54 to the heat sink 56. Moreover, the MCPCB can attach to the heat sink via other fastening methods, for example screws, welding, rivets and the like. Attachment of the MCPCB 54 to the heat sink 56 using the cams 58 is more particularly described in U.S. Patent Application Publication No. US 2005/0265019 A1.

With reference back to FIG. 2, the reflector 62 mounts to at least one of the MCPCB 54 and the heat sink 56. The reflector 62 in the depicted embodiment includes an upper reflective surface 86 and a lower surface 88. The upper reflective surface 86 directs light emitted from the LED devices 52 towards products that are disposed inside the commercial refrigeration unit and acts as the primary reflective surface for the assembly. The reflector can include ridges that run parallel to a longitudinal axis of the reflector and the assembly. The reflector can comprise metal, plastic, plastic covered with a film, and transparent plastic using the method of total internal reflection to direct light similar to a conventional reflector, as well as other conventional materials. The reflective surface 86 can be polished to further increase the efficacy.

Figure 3:
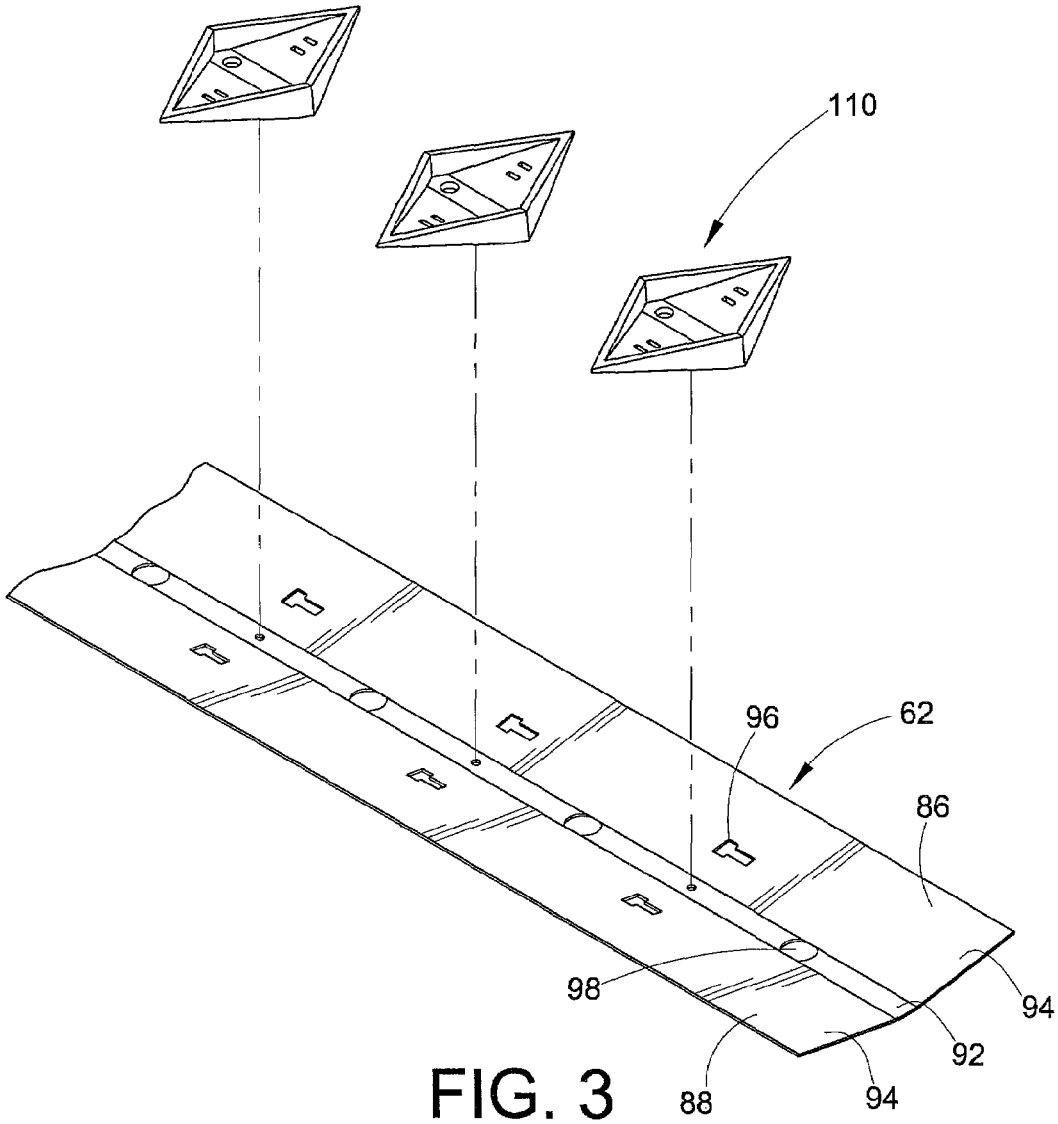
FIG. 3 is a close-up perspective view of a portion of a primary reflector and a booster optic for the lighting assembly depicted in FIG. 2.

As more clearly seen in FIG. 3, the reflector 62 can have a somewhat V-shaped configuration that includes a substantially planar central portion 92 that runs along the central axis of the reflector 62 and upwardly extending planar portions 94 that are at an angle to the central portion 92. In the depicted embodiment, the angled portions 94 are at a small angle from the central portion 92, which will be described in more detail below. The lower surface 88 of the reflector 62 contacts the upper most fins 82 of the heat sink 56 and terminates near a longitudinal edge of the upper most fins. The reflector 62 is symmetrical about its longitudinal axis.

The reflector 62 includes booster optic fastening openings 96 formed in the angled portions 94 of the reflector. These openings 96 will be described in more detail below. The reflector 62 also includes LED device openings 98 that are appropriately dimensioned to receive the LED devices 52 that are mounted on the MCPCBs 54. The LED device openings 98 are aligned along the central longitudinal axis of the reflector 62, and are formed in both the central portion 92 and the upwardly angled portions 94.

The LED devices 52 that are used in the depicted embodiment are side emitting LED devices, which are available from LumiLeds Lighting, U.S. LLC. Each LED device 52 includes a lens that mounts onto an LED body. The lens directs light emitted from the LED device 52 such that a majority of the light is emitted at a side of the lens as opposed to at a top of the lens. By using a side emitting LED device 52, the profile of the lighting assembly 50 can be very thin. Accordingly, a consumer viewing the inside of the commercial refrigeration unit does not see a plurality of point light sources, which has been found to be undesirable. Instead, the LED devices are hidden from the eyes of the consumer by the heat sink 56 and the cover 64.

The cover 64 mounts to the heat sink 56. The cover 64 includes a clear and/or translucent portion that allows light to pass through the cover. The translucent portion of the protective cover 64 can be tinted to adjust the color of the light emitted by the assembly. Alternatively, the primary reflective surface 86 of the reflector 62 can also be tinted to adjust the color of the light emitted from the assembly 50. In the depicted embodiment, the translucent portion of the cover 64 is tinted yellow. The yellow tint removes some of the blue component of the light that passes through the cover 64, which makes the light in the display case appear less blue. This has been found desirable by retailers.

The lighting assembly 50 can be used in a retrofit installation. The LED devices 52 can be in electrical communication with a power conditioning circuit (not shown), which can convert alternating current voltage to a direct current voltage. The power conditioning circuit for example can be adapted to convert 120 or 240 volt alternating current voltage to a direct current voltage. Also, the power conditioning circuit can correct for polarity of the incoming power so that the power supply wires that connect to the power conditioning circuit can be connected without having to worry about which wire connects to which element of the power conditioning circuit. The power conditioning circuit can be located on the printed circuit board 54, or alternatively the power conditioning circuit can be located off of the printed circuit board 54. For example, in one embodiment the power conditioning circuit can be located on an element that is disposed inside one of the end caps 74.

With reference to FIG. 3, a plurality of booster optics 110 attach to the reflector 62. The booster optic 110 promotes the generation of a light beam pattern that sufficiently illuminates products disposed in a commercial refrigeration unit. In the embodiment depicted in FIGS. 2 and 3, the booster optic 110 mechanically attaches to the reflector 62. In alternative embodiments, the booster optic 110 and the reflector 62 can be formed as an integral unit via stamping or similar method.

Figure 4:
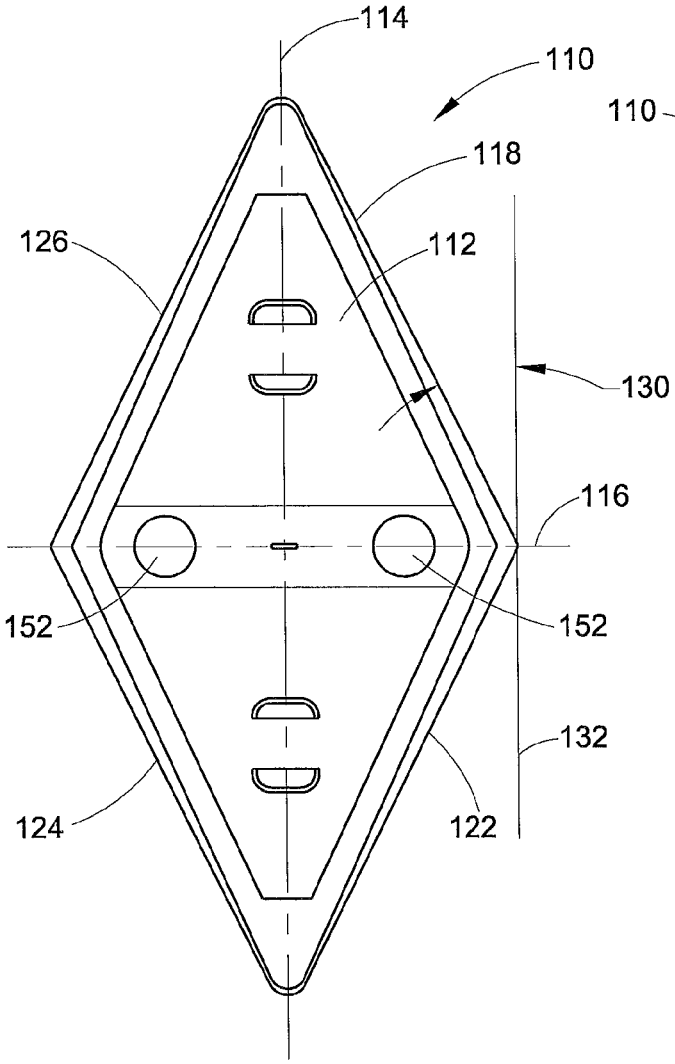

As more clearly seen in FIG. 4, the booster optic 110 includes a body that is axially symmetric about a first axis 114 and a second axis 116 that is perpendicular to the first axis.

The body 112 is substantially diamond shaped in plan view (see FIG. 4). The body 112 in the depicted embodiment is made from a molded plastic that has metallized reflective surfaces, which will be described in more detail below.

The booster optic 110 provides a secondary reflective surface for the light assembly 50. The booster optic 110 includes a first reflective surface 118, a second reflective surface 122, a third reflective surface 124 and a fourth reflective surface 126. The reflective surfaces 118, 122, 124, and 126 are generally defined by the axes 114 and 116 that bisect the booster optic body 112. The first axis 114 is generally perpendicular to the longitudinal axis of the primary reflector 62 when the assembly 50 is finally assembled (see FIG. 8). The second axis 116 is generally coaxial with the longitudinal axis of the primary reflector when the assembly is finally assembled.

Figure 7:
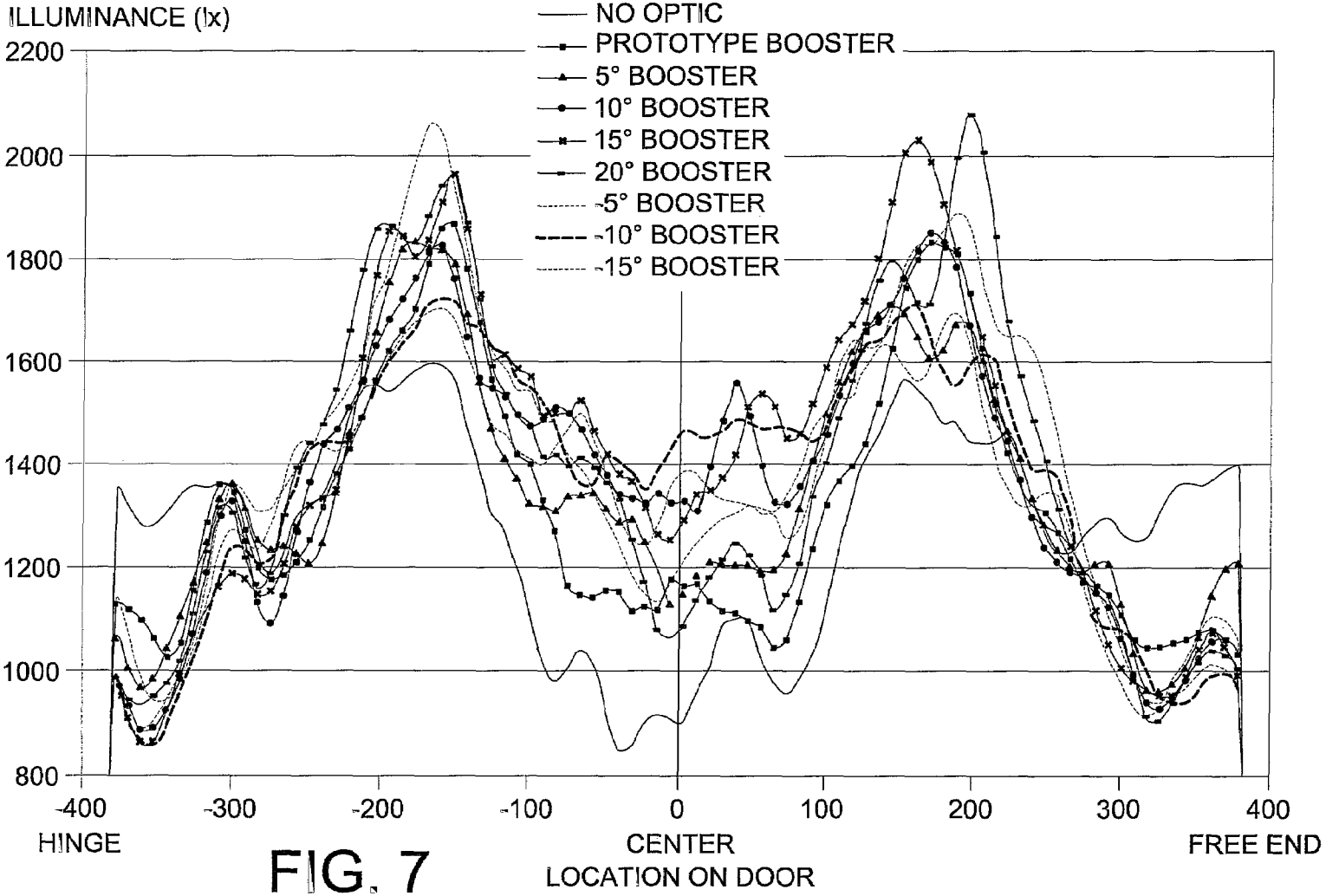
FIG. 7 is a graph depicting different illuminance values as a function of different angles chosen for the booster optic depicted in FIG. 3.

In plan view, the first reflective surface 118 of the booster optic 110 is disposed at an angle 130 to a third axis 132 that is parallel to the first axis 114 of the body 112 and intersects a line at which the first reflective surface 118 adjoins the second reflective surface 122. The angle 130 is determined to provide a generally uniform illuminance (measured in lx) along the door, which coincides with the shelf, of the display case. With reference to FIG. 7, booster optics having a different angles with respect to the third axis 132 were tested to determine the illuminance across the door (for example door 24 in FIG. 1). Positive angles are measured clockwise from the third axis 132 toward the second axis 116 and negative angles are measured counterclockwise from the third axis 132 toward the second axis 116.

Figure 6:
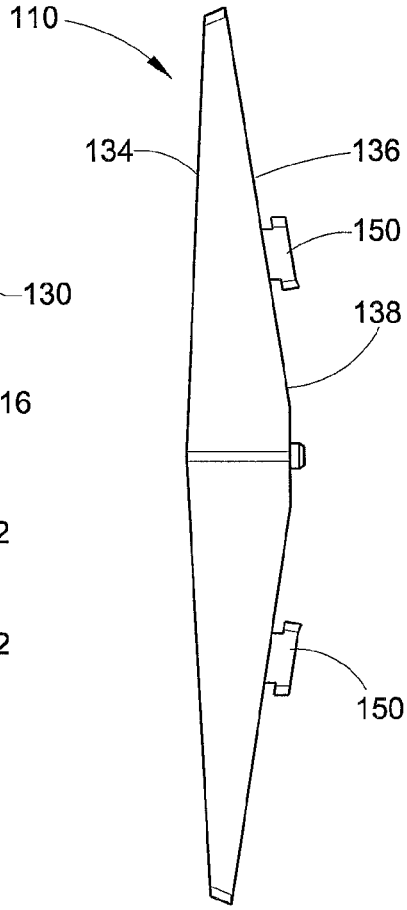

As seen in FIG. 6, the first secondary reflective surface 118 is also defined by an upper edge 134 and a lower edge 136. The upper edge 134 is limited by the cover 64 (FIG. 2) of the assembly 50. The lower edge 136 abuts the upper reflective surface 86 (FIG. 3) of the primary reflector 62. The lower edge 136 of the first secondary reflective surface 118 also defines an edge of a lower surface 138 of the body 112. The lower surface 138 of the body 112 also abuts the upper reflective surface 86 of the reflector 62. Accordingly, the lower surface 138 is also somewhat V-shaped as can be seen in FIG. 6.

Figure 5:
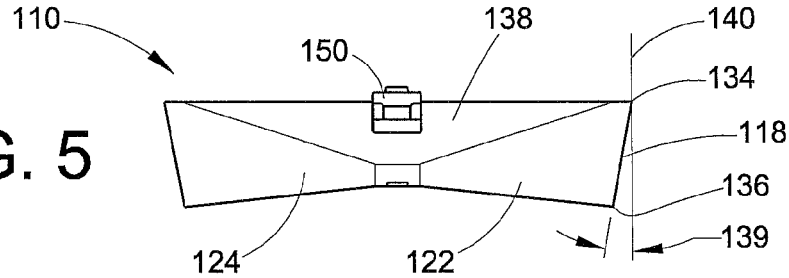
FIGS. 4, 5 and 6 are plan, end and side views, respectively, of the booster optic depicted in FIG. 3.

As more clearly seen in FIG. 5, the first secondary reflective surface 118 is also disposed at an angle 138 to a fourth axis 140 that is perpendicular to both the second axis 116 and the third axis 132. The fourth axis 140 is also generally normal to the primary reflective surface 86. Accordingly, the first secondary reflective surface 118 is at an obtuse angle with respect to the primary reflective surface. This angle 138 is disposed such that light that contacts the first secondary reflective surface 118 is directed further outwardly from a plane in which the upper reflective surface 86 of the reflector 62 resides.

Figure 8:
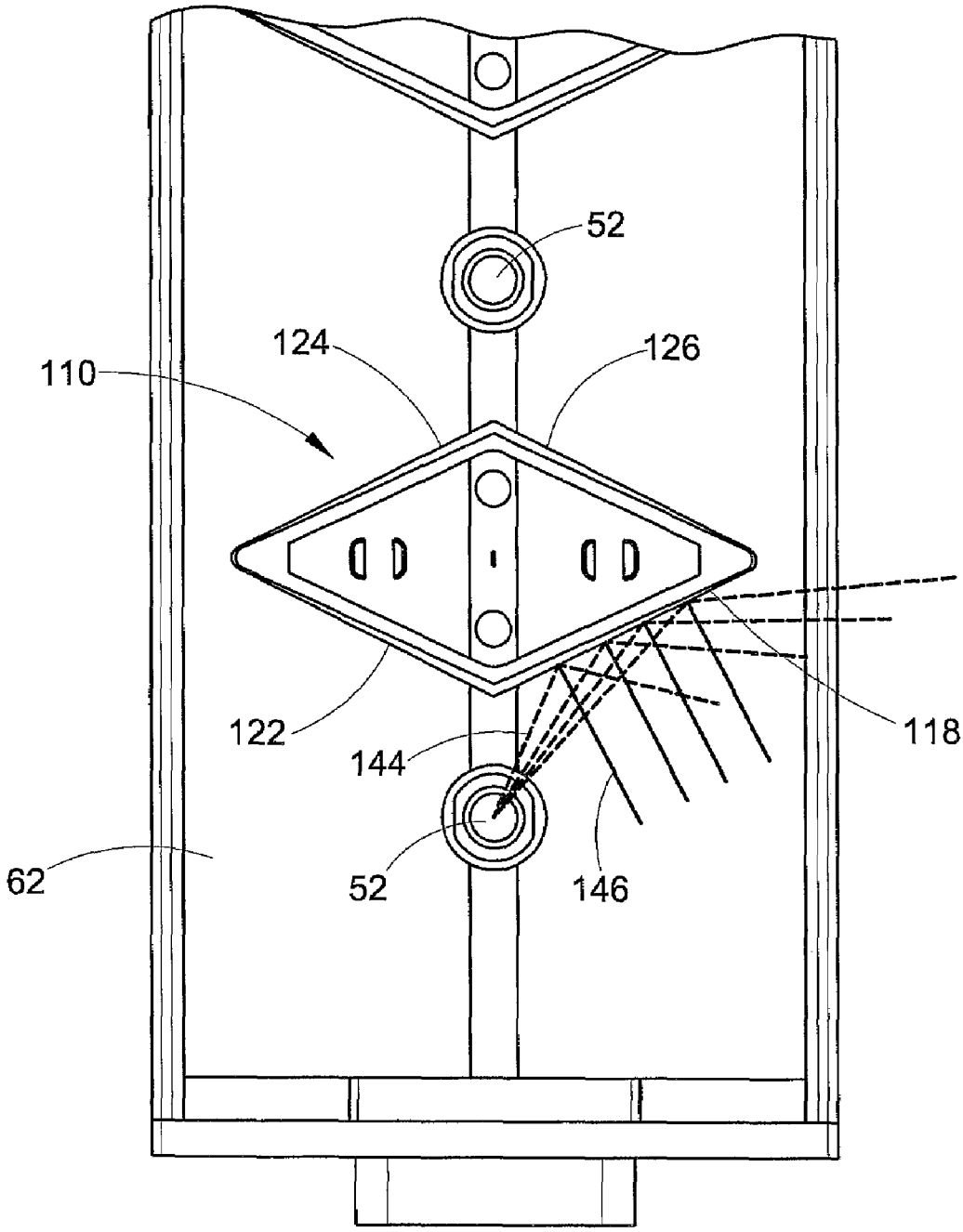
FIG. 8 is a plan view of a lower portion of the lighting assembly of FIG. 2 depicting light being redirected by the booster optic.

With reference to FIG. 8, light 144 (depicted schematically) contacts the first secondary reflective surface 118 of the booster optic 110 and is redirected with respect to mirror lines 146 that are normal to the first secondary reflective surface 118. Light rays reflected off of the first secondary reflective surface 118 are redirected to the primary reflector 62 and/or the center portion of the door 24 (FIG. 1). The booster optic 110 blocks vertically (per the orientation depicted in FIG. 8) traveling rays and redirects these rays either toward the main reflector 62 or towards items located on the shelf of the display case. Light that contacts any of the secondary reflective surfaces is redirected further away from the central axis of the primary reflector 62. Since the booster optic 110 is symmetric about the first axis 114 and the second axis 116 (both axes shown in FIG. 4) light that contacts these other secondary reflective surfaces, i.e. surfaces 122, 124 and 126, is redirected in a similar manner to that shown in FIG. 8.

With further reference to FIG. 8, a single booster optic 110 can redirect light emitted from at least two LED devices 52. For example, the third secondary reflective surface 124 and the fourth secondary reflective surface 126 can cooperate with the upper LED device 52 shown in FIG. 8 while the first secondary reflective surface 118 and the second secondary reflective surface 122 can cooperate with the lower LED device 52 as it is depicted in FIG. 8. Accordingly, with reference back to FIG. 2, a plurality of booster optics 110 are mounted on an upper surface 86 of the reflector 62 and one LED device opening 98 is disposed between adjacent booster optics 110.

The booster optic 110 is useful in that it redirects light from the LED devices 52 that does not contact the primary reflective surface 86 of the reflector 62. The booster optic 110 redirects light emanating from the LED devices 52 to create a more uniform illuminance characteristic as compared to an illuminance characteristic created without a booster optic. With reference back to FIG. 7, the solid line indicates an illuminance pattern where no booster optic is used with the light assembly. It is apparent in the graph depicted in FIG. 7 that the center portion (0 on the y-axis in FIG. 7) of the door 24 has a low illuminance value as compared to a location on the door located generally between a hinge of the door and the center of the door (i.e. a one-quarter portion of the door), and a portion of the door between the center of the door and the free end of the door (i.e. a three-quarter portion of the door). By placing a booster optic 110 having an appropriate angle 130, a more uniform illuminance pattern characteristic can be provided along the door.

The booster optic 110 includes tabs 150 that extend from a lower surface 138 of the body 112 to facilitate attachment of the booster optic to the primary reflector 62. With reference back to FIG. 3, the tabs 150 are appropriately dimensioned to snap into the openings 96 formed in the primary reflector 62. Openings 152 can be formed in the body 112 so that additional fastener or an adhesive such as an epoxy can be used to attach the booster optic 110 to the primary reflector 62.

Figure 9:
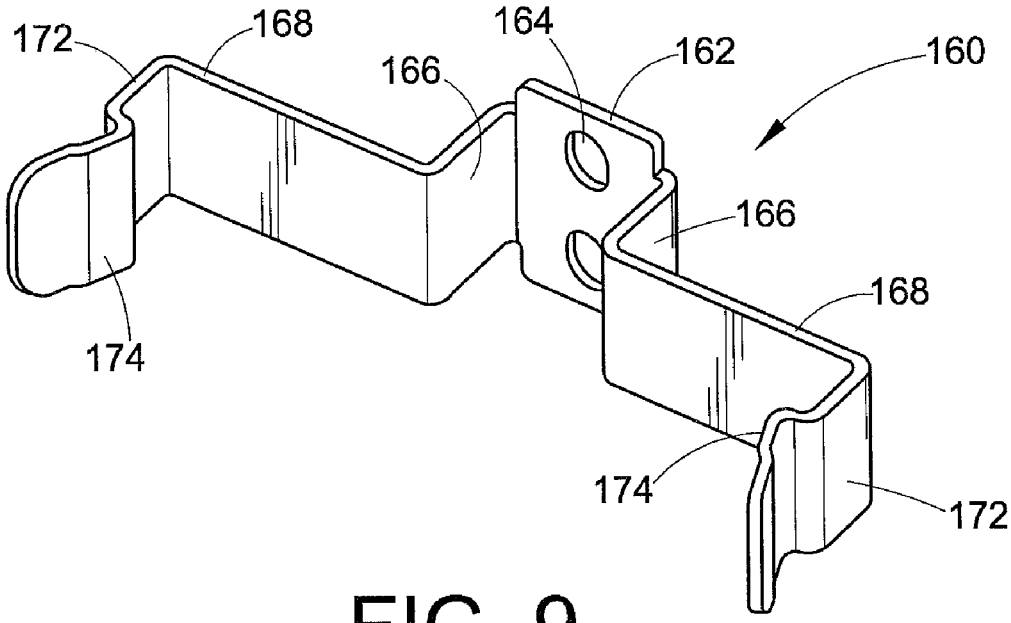
FIG. 9 is a perspective view of a mounting clip for mounting the lighting assembly depicted in FIG. 2 in a refrigerated display case such as the one depicted in FIG. 1.

With reference to FIG. 9, a mounting clip 160 can be used to attach the lighting assembly 50 to the mullion, for example the mullion 36 depicted in FIG. 1. The mounting clip 160 includes a central base portion 162 that will abut the mullion when mounted to it. Fastener openings 164 are provided for attaching the mounting clip 160 to the mullion. The mounting clip 160 is symmetrical about an axis that bisects the openings 164 and the base portion 162. A central standoff portion 166 extends from opposite sides of the base portion 162. In the depicted embodiment, the stand off portions 166 extend at a right angle to the base portion 162. Intermediate portions 168 extend from the stand off portions 166 at a right angle to the stand off portions. Outer portions 172 extend from the intermediate portions 168. The outer portions 172 are spaced from one another substantially the same distance as the width of the heat sink 56 (FIG. 2). Each outer portion 172 includes an inwardly extending protrusion 174. The protrusions 174 are set off a distance from the intermediate portions 168 substantially equal to the depth of the heat sink 56. The heat sink is retained by the outer portions 172 and the protrusions 174 cooperating with the intermediate portions 168.

The mounting clip 160 is made from a spring steel so that it is resilient. Surfaces of the mounting clip 160 that contact the heat sink 56 can be dipped in a solvent-based rubber coating to increase the coefficient of friction between the mounting clip 160 and the heat sink 56 so that the heat sink does not move in a direction parallel to its longitudinal axis when it has been received between the outer portions 172 and the protrusions 174 in the intermediate portions 168.

Figure 10:
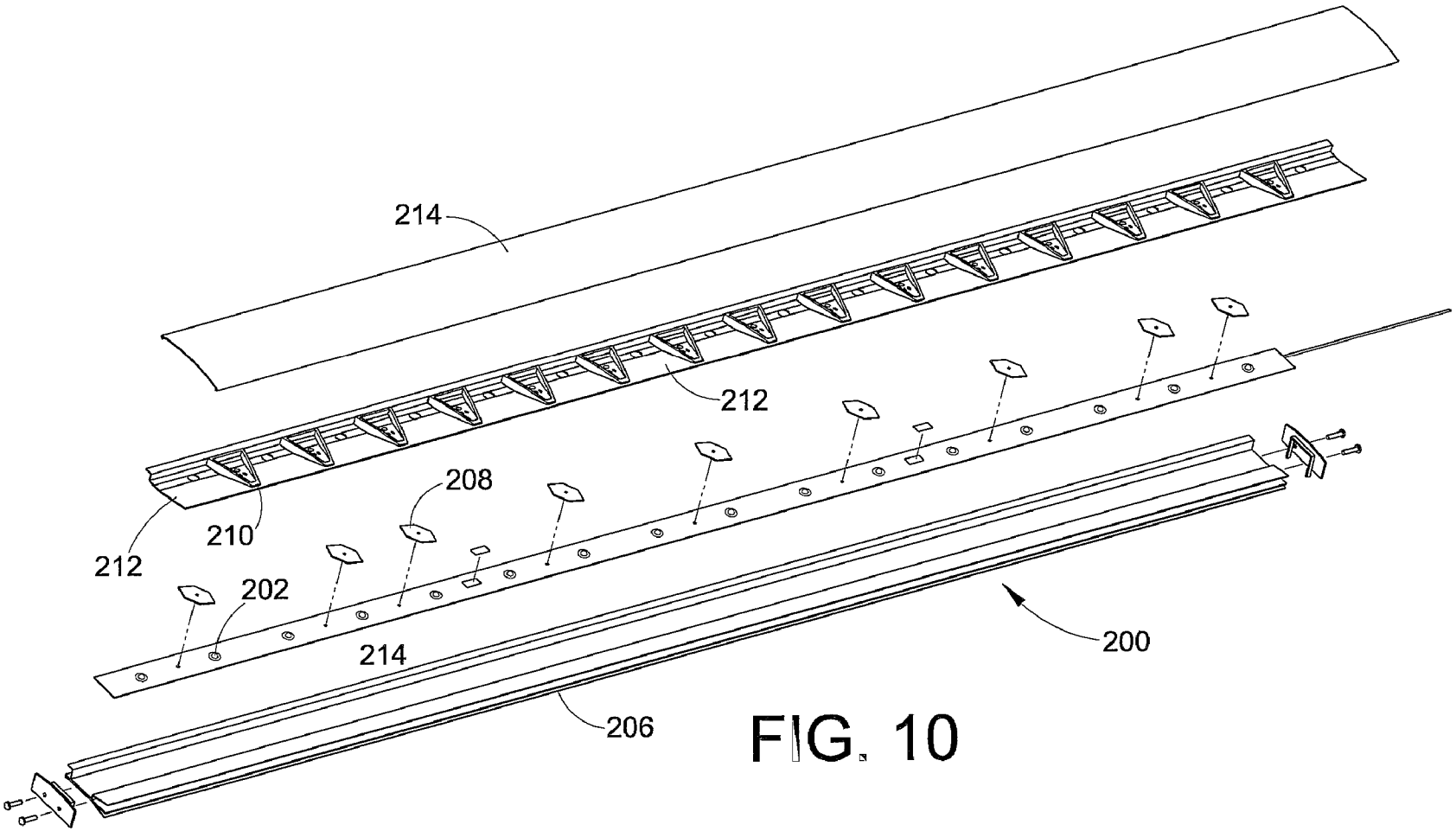
FIG. 10 is an exploded view of a lighting assembly configured to be mounted in a corner of a display case such as the one depicted in FIG. 1.

With reference to FIG. 10, another embodiment of a lighting assembly 200 is disclosed. The lighting assembly 200 is similar to the lighting assembly 50 described with reference to FIGS. 2-9. This lighting assembly 200, however, is configured to be mounted in a corner of a display case, for example the display case 10 (FIG. 1) such that light is typically directed to only one side of the assembly. The lighting assembly 200 includes a plurality of LED devices 202 mounted on printed circuit boards 204. The printed circuit boards 204 mount to a heat sink 206 using fastening devices 208. A reflector 212 also connects to the heat sink 206. A translucent cover 214 also attaches to the heat sink 206 and covers the LED devices 202. In this embodiment, the LED devices 202, the circuit board 204, and the fastening devices 208 are the same, or very similar, to the devices described with reference to FIGS. 2-9. In this embodiment, the heat sink 206 has a smaller width than the heat sink 56 described with reference to FIGS. 2-9. This allows the heat sink 206 to connect to a corner mullion, which is typically smaller than a central mullion.

Figure 11:
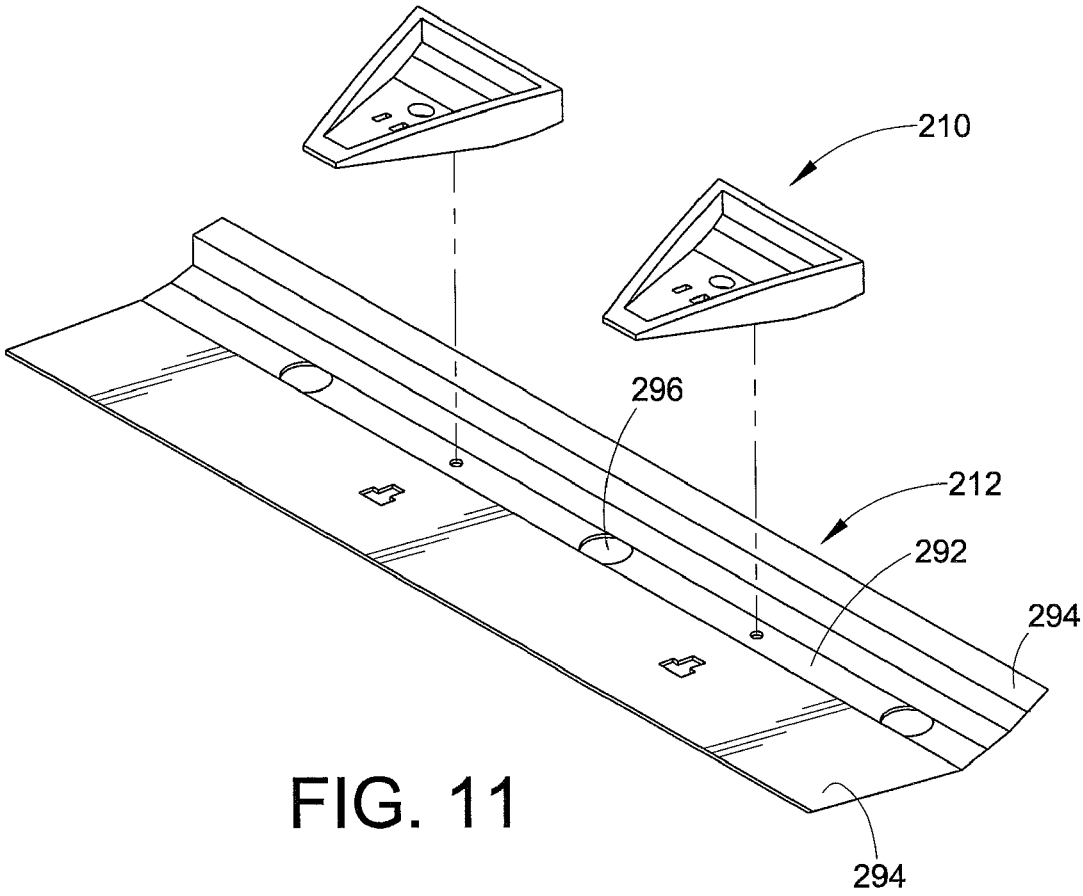
FIG. 11 is close-up perspective view of a portion of a primary reflector and a booster optic for the lighting assembly depicted in FIG. 10.
Figure 13:
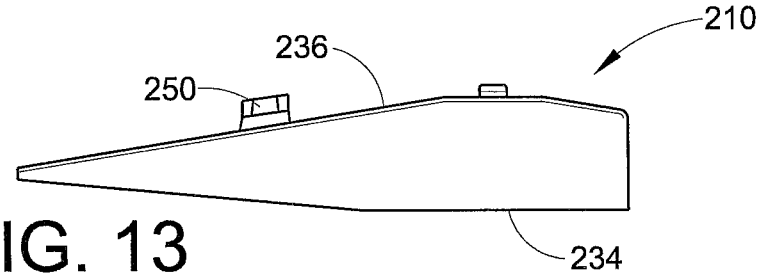
FIGS. 12, 13 and 14 are plan, end and side views, respectively, of the booster optic depicted in FIG. 11.

The reflector 212 is also slimmer as compared to the reflector 62 described with reference to FIG. 2. The reflector 212 includes the primary reflective surface 290 for the assembly 200. The reflector 212 is still somewhat V-shaped and includes a substantially planar central region 292 and upwardly extending portions 294. As seen in FIG. 11, one of the extending portions extends a greater distance from the central region as compared to the opposite extending portion. The reflector 212 also includes LED device openings 296 that receive the LED devices 202. The lighting assembly 200 described in FIGS. 10 and 11 can mount to the mullion in a manner similarly to the lighting assembly 50 described above.

With reference back to FIG. 10, a plurality of booster optics 210 attach to the reflector 212. The booster optics 210 are made from a similar material as the booster optics 110 which have been described above. In the embodiment depicted in FIGS. 10 and 11, the booster optic 210 mechanically attaches to the reflector 212 in a similar manner that the booster optic 110 attached to the reflector 212. In alternative embodiments, the booster optic 110 and the reflector 212 can be formed as an integral unit via stamping or similar method.

Figure 12:
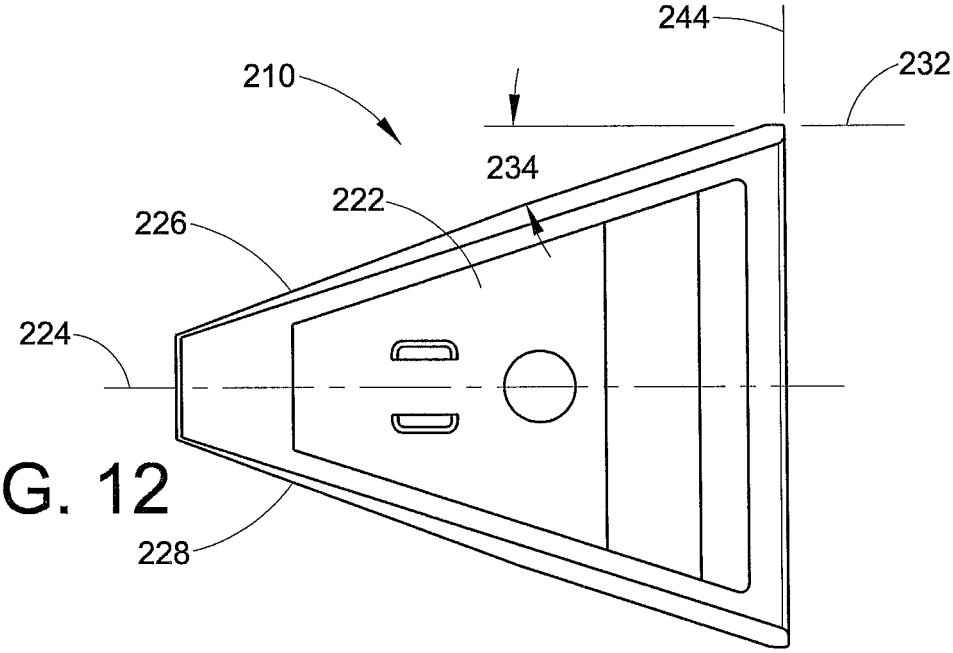

As more clearly seen in FIG. 12, the booster optic 210 includes a body 222 that is axially symmetric about a first axis 224. The first axis 224 is generally perpendicular to the longitudinal axis of the primary reflector 212 when finally assembled. The body 222 has an isosceles trapezoidal shape in plan view (see FIG. 12).

The booster optic 210 provides a secondary reflective surface for the light assembly 200. The secondary reflective surface includes a first reflective surface 226 and a second reflective surface 228. The reflective surfaces can be metallized.

In plan view, the first reflective surface 226 of the booster optic 110 is disposed at an angle 230 to an axis 232 parallel to the first axis 224 of the body 222. The angle 230 is similar to the angle 130, above, and is determined to provide a generally uniform illuminance across the door, which coincides with the shelf, of the display case.

The first secondary reflective surface 226 is also defined by an upper edge 234 and a lower edge 236. The upper edge 234 is limited by the cover 214 of the assembly 200. The lower edge 236 abuts the upper reflective surface 290 of the primary reflector 212. The lower edge 236 of the first secondary reflective surface 226 also defines an edge of a lower surface 238 of the body 222. The lower surface 238 of the body 222 also abuts the upper reflective surface 290 of the reflector 212.

Figure 14:
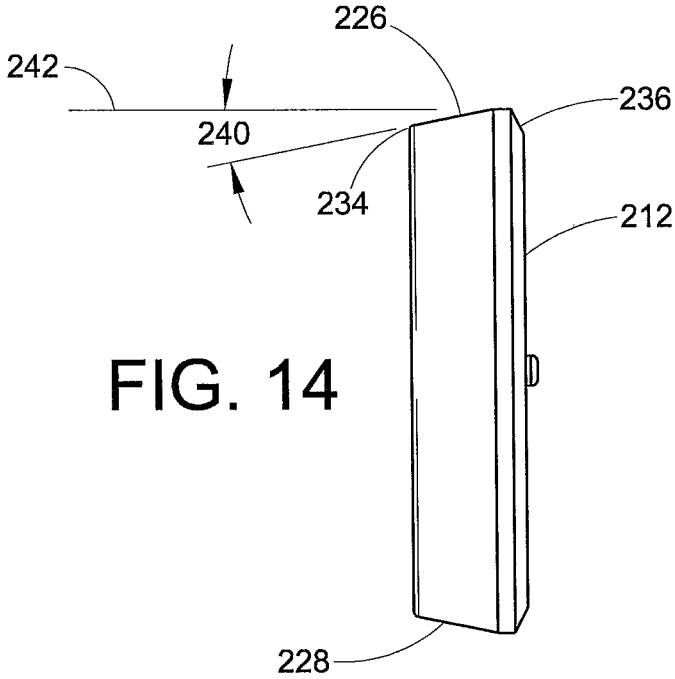

As more clearly seen in FIG. 14, the first secondary reflective surface 226 is also disposed at an angle 240 to an axis 242 that is perpendicular to both the axis 232 and a line 244 that runs along the wider lateral end of the body 222. This angle 240 is configured such that light that contacts the secondary reflective surface is directed further outwardly from a plane in which the upper reflective surface 290 of the primary reflector 212 resides.

Similar to the booster optic described above, light rays reflected off of the first secondary reflective surface 226 are redirected to the primary reflector 212 and/or the center portion of the door 24 (FIG. 1). The booster optic 210 blocks vertically traveling rays and redirects these rays either toward the main reflector 212 or towards the components stored on the shelf of the display case. Light that contacts any of the secondary reflective surfaces is redirected further away from the central axis of the primary reflector 212. Since the booster optic 210 is symmetric about the first axis 214, light that contacts the other secondary reflective surface 228 is redirected in a similar manner as light that contacts the first secondary reflective surface 226.

The booster optic 210 includes tabs 250 that extend from the lower surface 238 of the body 222 to facilitate attachment of the booster optic to the primary reflector 212. With reference back to FIG. 11, the tabs 250 are appropriately dimensioned to snap into the openings 296 formed in the primary reflector 212. Openings 252 can be formed in the body 222 so that additional fasteners or an adhesive such as an epoxy can be used to attach the booster optic 210 to the primary reflector 212.

Figure 15:
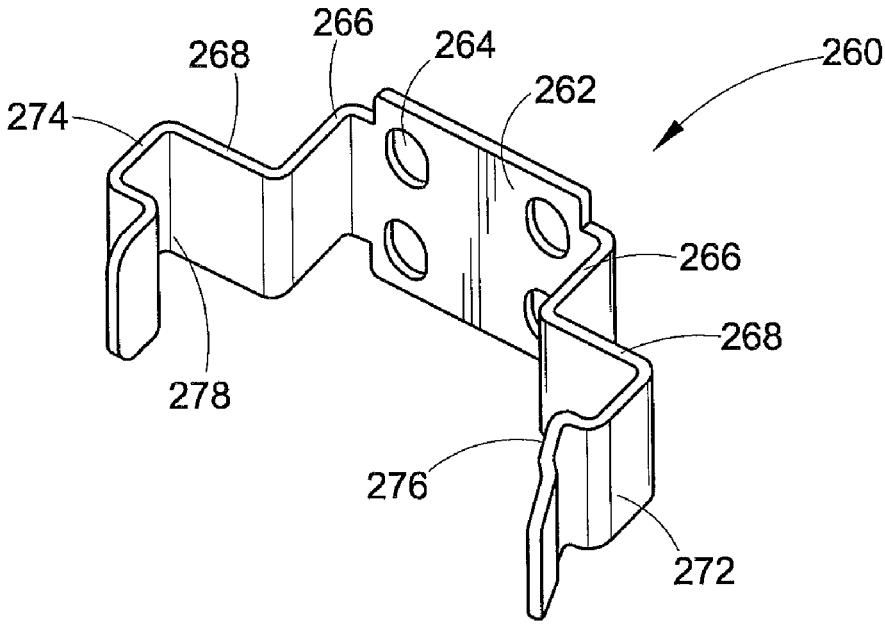
FIG. 15 is a perspective view of a mounting clip used to mount the lighting assembly of FIG. 10 inside a display case such as the one depicted in FIG. 1.

With reference to FIG. 15, a mounting clip 260, similar to the mounting clip 160 that is described above, can be used to attach the lighting assembly 200 to the mullion, for example a corner mullion depicted in FIG. 1. The mounting clip 260 includes a central base portion 262 that will abut the mullion when mounted to it. Fastener openings 264 are provided for attaching the mounting clip 260 to the mullion. A central standoff portion 266 extends from opposite sides of the base portion 262. The stand off portions 266 extend at a right angle to the base portion 262. Intermediate portions 268 extend from the stand off portions 266 at a right angle to the stand off portions. Outer portions extend from the intermediate portions 268. A first outer portions 272 is similarly shaped to the outer portions 172 described above. A second outer portion 274 is spaced from substantially the same distance as the width of the heat sink 206 (FIG. 10). The first outer portion 272 includes an inwardly extending protrusion 276. The protrusions 274 is set off a distance from the intermediate portions 268 substantially equal to the depth of the heat sink 206. The second outer portion 274 defines a channel 278 to retain the heat sink 206.

The mounting clip 260 is made from a spring steel so that it is resilient. Surfaces of the mounting clip 260 that contact the heat sink 206 can be dipped in a solvent-based rubber coating to increase the coefficient of friction between the mounting clip 260 and the heat sink 206 so that the heat sink does not move in a direction parallel to its longitudinal axis when it has been received by the mounting clip.

The lighting systems have been described with reference to the disclosed embodiments. Furthermore, components that are described as a part of one embodiment can be used with other embodiment. The invention is not limited to only the embodiments described above. Instead, the invention is defined by the appended claims and the equivalents thereof.

The invention claimed is:

1. A lighting assembly for illuminating items in a display case, the assembly comprising:

a plurality of LED devices;

a reflector having a longitudinal axis and disposed in relation to the LED devices such that light emitted from the LED devices reflects from a primary reflective surface of the reflector and is directed toward items in the display case; and a booster optic extending from the primary reflective surface of the reflector in a direction which is generally the same as a direction that each of the plurality of LED devices extend with respect to the reflective surface, the booster optic including a first reflective surface associated with a first LED device of the plurality of LED devices and a second reflective surface associated with a second LED device of the plurality of LED devices.

2. The assembly of claim 1, wherein the booster optic is a separate component from the reflector, and the booster optic is fastened to the reflector.

3. The assembly of claim 1, wherein the booster optic is integrally formed with the reflector.

4. The assembly of claim 1, wherein the first reflective surface being configured and positioned with respect to the first LED device such that light emitted from the first LED device towards the first reflective surface reflects from the first reflective surface and is redirected away from the central axis of the primary reflective surface in a plane that is generally parallel with a plane in which the longitudinal axis resides.

5. The assembly of claim 1, wherein the first reflective surface being configured and positioned with respect to the first LED device such that light emitted from the first LED device towards the first reflective surface reflects from the first reflective surface and is redirected further away from the central axis of the primary reflective surface in a plane that is angled with respect to a plane in which the longitudinal axis resides.

6. The assembly of claim 1, wherein the first reflective surface is configured and positioned with respect to the first LED device such that light emitted from the first LED device towards the first reflective surface reflects from the first reflective surface and is redirected away from the longitudinal axis the second reflective surface is configured and positioned with respect to the second LED device such that light emitted from the second LED device towards the secondary reflective surface reflects from the second second reflective surface and is redirected away from the longitudinal axis.

7. The assembly of claim 1, wherein the first reflective surface is generally planar and defined by a lower edge that abuts against the primary reflective surface, a plane in which the first reflective surface resides being disposed at an obtuse angle with respect to a plane in which a portion of the primary reflective surface adjacent the lower edge resides.

8. A light assembly comprising:

a first LED device;

a primary reflector disposed with respect to the first LED device such that light emanating from the first LED device is redirected from the primary reflector towards a desired location to form a first illuminance pattern;

a booster optic disposed with respect to the first LED device and the primary reflector such that light emanating from the first LED device is redirected towards at least one of the desired location and the primary reflector to form a second illuminance pattern that when combined with the first illuminance pattern provides a combined illuminance pattern having a more uniform illuminance characteristic as compared to the first illuminance pattern.

9. The assembly of claim 8, further comprising a second LED device, the primary reflector being disposed with respect to the second LED device such that light emanating from the second LED device is redirected from the primary reflector towards a desired location to form a third illuminance pattern that is similar to the first illuminance pattern although offset from the first illuminance pattern a function of the distance between the first LED device and the second LED device, and the booster optic is configured and disposed with respect to the second LED device and the primary reflector such that light emanating from the second LED device is redirected towards at least one of the desired location and the primary reflector to form a fourth illuminance pattern that when combined with the third illuminance pattern provides a combined illuminance pattern having a more uniform illuminance characteristic as compared to the third illuminance pattern.

10. The assembly of claim 8, wherein the booster optic is symmetric about two mutually perpendicular axes.

11. The assembly of claim 8, further comprising a heat sink connected to the primary reflector and a mounting clip connected to the heat sink, the mounting clip being configured to attach to a mullion of an associated display case.

12. The assembly of claim 8, wherein the booster optic includes a tab for fastening the booster optic to the primary reflector.

13. The assembly of claim 8, wherein the booster optic includes a first reflective surface configured to redirect light away from a longitudinal axis of the primary reflector in a first direction and a second reflective surface configured to redirect light away from the longitudinal axis of the primary reflector in a second direction.

14. The assembly of claim 8, further comprising a second LED device, the booster optic including a first reflective surface for redirecting light from the first LED device and a second reflective surface for redirecting light from the second LED device.

15. A lighting assembly for illuminating items in a display case, the assembly comprising:

a reflector having a longitudinal axis and a primary reflective surface angled with respect to the longitudinal axis;

a plurality of LEDs disposed along the longitudinal axis in relation to the reflector such that light emitted from the LED devices reflects from the reflector and is directed toward items in the display case; and a plurality of booster optics extending from the primary reflective surface of the reflector, each booster optic including a first reflective surface associated with a respective LED device of the plurality of LED devices, the first reflective surface being configured and positioned with respect to the respective LED device such that light rays emitted from the respective LED device in a direction generally parallel to the longitudinal axis are redirected away from the longitudinal axis of the reflector.

16. The assembly of claim 15, wherein each booster optic further includes a second reflective surface, both the first reflective surface and the second reflective surface being configured to redirect light from the first LED device, wherein the first reflective surface directs light away from the longitudinal axis in a first direction and the second reflective surface directs light away from the longitudinal axis in a second, opposite, direction.

17. The assembly of claim 15 further comprising a translucent cover covering the LED devices, wherein each booster optic includes a lower edge that abuts the primary reflective surface and an upper edge limited by the cover.

18. The assembly of claim 15, wherein at least one booster optic redirects light from at least two LEDs.

19. The assembly of claim 15, wherein the first reflective surface is disposed at an obtuse angle with respect to the primary reflective surface.

20. The assembly of claim 15, wherein the booster optic is generally diamond shaped in a plain view.

21. The assembly of claim 15, wherein the reflector is V-shaped.

* * * * *